US006138630A

United States Patent [19]

Lazcano-Navarro

[11] Patent Number: 6,138,630

[45] Date of Patent: Oct. 31, 2000

[54] CYLINDER LINERS FOR ALUMINUM MOTOR BLOCKS AND METHODS OF PRODUCTION

[75] Inventor: Arturo Lazcano-Navarro, Monclova, Mexico

[73] Assignee: Metalicos de Tecnologia Avanzada, S.A. de C.V., Ana Monclova, Mexico

[21] Appl. No.: 09/428,926

[22] Filed: Oct. 28, 1999

[51] Int. Cl.[7] ..... F02F 1/16

[52] U.S. Cl. ..... 123/193.2; 29/888.061

[58] Field of Search ..... 123/193.2, 41.84; 29/888.061

[56] References Cited

U.S. PATENT DOCUMENTS

| | | | |
|---|---|---|---|
| 2,062,394 | 12/1936 | Brown | 123/193.2 |
| 4,221,196 | 9/1980 | Castarede | 123/193.2 |
| 4,523,554 | 6/1985 | Ryu . | |
| 4,926,801 | 5/1990 | Eisenberg et al. | 123/193.2 |
| 5,183,025 | 2/1993 | Jorstad et al. . | |
| 5,749,331 | 5/1998 | Pettersson et al. | 123/193.2 |
| 5,957,103 | 9/1999 | Takami et al. | 123/193.2 |

*Primary Examiner*—Marguerite McMahon

*Attorney, Agent, or Firm*—Breiner & Breiner

[57] ABSTRACT

A generally hollow cylindrical piston liner for insertion in an internal combustion engine between a piston and an engine block has a cast aluminum piston liner body with cast iron engine block contact surface structure extending therefrom and securely thermally bonded thereto for exhibiting a roughened outer contact surface adapted to interface with an engine block, and its method of manfacture. The cast iron contact surface member roughened surface is generated by introducing in a first mold step a mold wash substance that generates a substantially uniform bubble pattern within a mold wash matrix layer into which the molten iron is poured to thereby produce a roughened iron interface surface. The aluminum piston liner is then bonded to the iron liner in a second molding step by pouring molten aluminum into a pre-heated mold to bond the cast iron engine block surface structure to the aluminum liner. During the solidification stages, the molds are centrifugally rotated about the piston liner cylinder axis to established the required manufacturing precision required for large diameter piston liners. The piston liners typically form a series of circumferal motor block contact ribs spaced proportionately along the liner length to extend from a cylindrical body for carrying the cast iron contact surface structure.

22 Claims, 2 Drawing Sheets

CYLINDER LINERS FOR ALUMINUM MOTOR BLOCKS AND METHODS OF PRODUCTION

TECHNICAL FIELD

This invention relates to iron-aluminum bimetallic liners for combustion engines, typically with aluminum motor blocks, and their manufacture, and more particularly it relates to bimetallic aluminum-iron cylinder liners and for producing the liners by casting methods bonding iron to aluminum.

BACKGROUND ART

Cylinder liners are known in the art as typified by U.S. Pat. Nos. 4,523,554 to H. Ryu, Jun. 18, 1985 and 5,183,025 to J. L. Jorstad, et al. Feb. 2, 1993. These liners interface thermal energy transfer between the piston and engine block. Cylinder liners are also known having provisions for introducing fluid flow paths to control transfer of thermal energy from the pistons to the engine block.

When aluminum cylinder liners are made in part of iron forming a contact surface for interfacing the engine block, with the aluminum portion interfacing with the piston, there are considerable problems in bonding the two metals together well enough to process the considerable forces and temperatures encountered in use. Such problems are in part introduced at the iron-aluminum interfaces by the large differences in melting temperatures of iron and aluminum, and thus make casting of the bimetallic cylinder liners difficult.

Another problem of producing the cylinder liners is the desire to have a roughened surface on the iron interface which contacts the aluminum engine block as a feature of handling thermal transfer of energy between the piston and the engine block.

Accordingly it has not been feasible heretofore to make inexpensive cast aluminum cylinder liners faced with iron liner surfaces, and in particular those with iron surfaces having roughened insulation type contact surfaces.

One significant problem in producing thin iron circumferential layers upon aluminum liner bodies, is the provision of the precise tolerances necessary, particularly for larger diameter pistons.

Thus, it is the objective of this invention to correct these problems of the prior art with a novel bimetallic iron-aluminum cylinder liner and its method of manufacture.

DISCLOSURE OF THE INVENTION

A generally hollow cylindrical piston liner for insertion in an internal combustion engine between a piston and an engine block has a cast aluminum piston liner body with a cast iron engine block contact surface member extending circumferentially from its outer cylindrical surface. Thus a thin iron layer is securely thermally bonded to ribs extending from the liner body to exhibit a roughened motor block contact surface.

The cast iron liner with the roughened surface is generated by introducing onto a mold cavity surface a mold wash substance that adheres to and forms a layer on the mold cavity surface and in the process of casting generates a substantially uniform bubble pattern to thereby produce a roughend iron interface surface of appropriate texture before molten iron is poured onto the wash layer.

The aluminum piston liner is then bonded to the iron liner by pouring molten aluminum over the iron liner in a preheated piston liner mold. During the solidification stages, the molds are centrifugally rotated about the piston liner cylinder axis to establish the required manufacturing precision for large diameter piston liners. The piston liners have a series of circumferal ribs spaced proportionately along the liner length and these ribs are interfaced with the iron liner surfaces.

This results in a cast aluminum piston liner for insertion in an internal combustion engine between a piston and an engine block comprising a hollow cylindrical cast aluminum liner body for receiving the piston having a plurality of spaced circumferential aluminum ribs extending from its outer surface for supporting a thermal contact iron interface surface between the cylindrical liner body and a mating surrounding engine block surface. The thermal contact surface is formed as a cast iron engine block contact member with a roughened outer surface, wherein the iron member is thermally bonded onto the circumferential aluminum ribs extending from the cylindrical liner body.

Thi invention provides a method of molding the cylindrical cast aluminum piston liner having externally protruding aluminum ribs covered by a cast surface layer of iron roughened at the outer surface for interfacing the resident engine block surface. Molds are prepared and preheated, where necessary, before pouring the respective molten iron and aluminum metals in a sequence of corresponding casting steps.

For producing a roughened outer surface on the cast iron layer, a layer of a mold wash substance is adhered to the mold inner surface to produce, before the pouring of molten iron into the mold, a mass of bubbles at the outer surface contact interface of the molten iron poured into the mold.

Placement of such cast iron liners into the aluminum piston cylinder molds before pouring molten aluminum then produces the bimetallic iron-aluminum piston liner. The piston mold containing iron liners is preheated to produce a better bonding at the iron-aluminum merging interface.

To obtain the very demanding precise cylindrical surfaces that are required in particular for larger size pistons and diesel engine pistons, the loaded molds are rotated about the cylindrical axis of said piston liner during solidification of molten metal.

Other objects features and advantages of the invention will be found throughout the following description, drawings and claims.

BRIEF DESCRIPTION OF THE DRAWINGS

In the accompanying drawings, wherein like reference characters refer to similar features throughout the various views to facilitate comparison.

THE PREFERRED EMBODIMENTS

Figure 1:
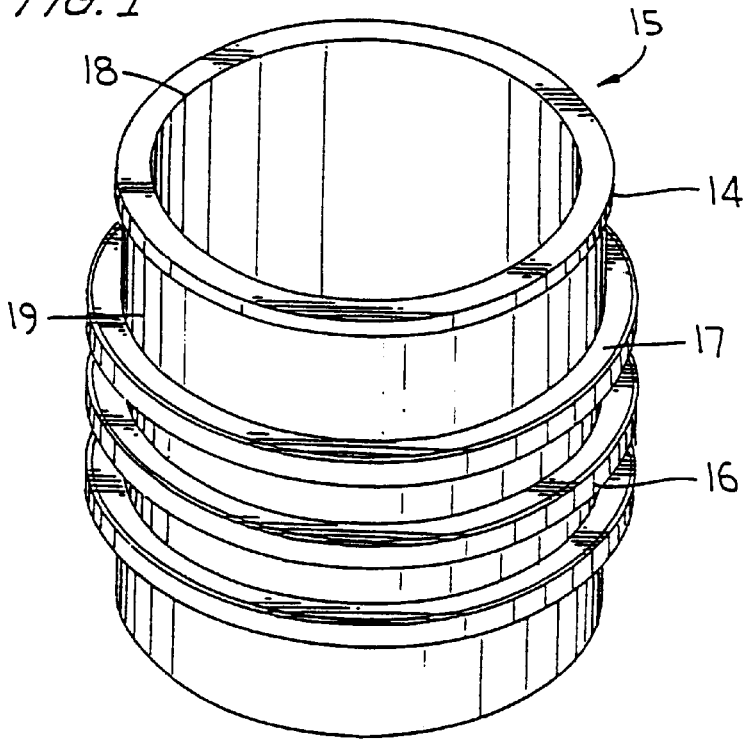
FIG. 1 is a perspective view of a typical cylinder liner embodiment afforded by this invention.
Figure 2:
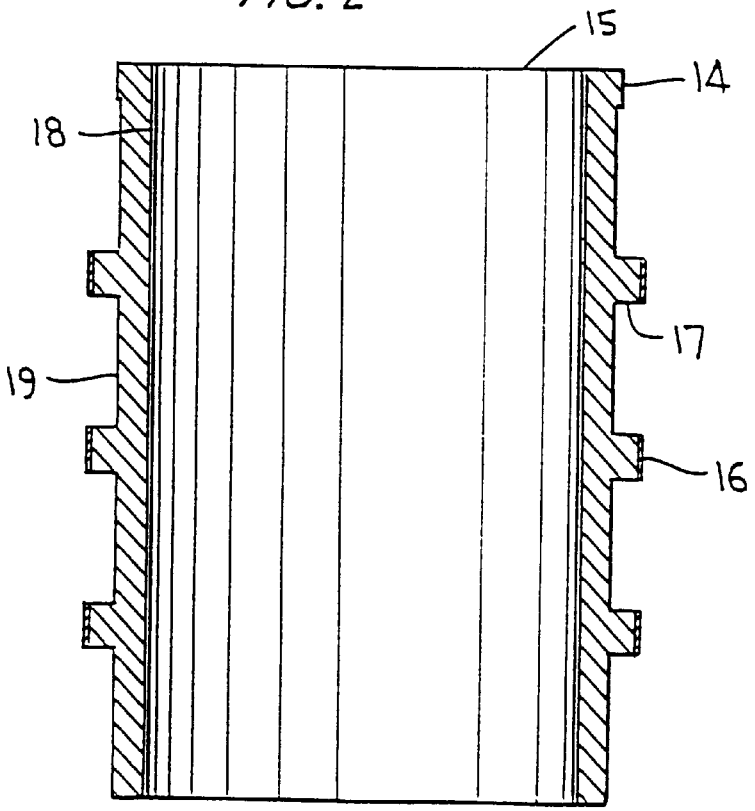
FIG. 2 is a semi-cylindrical section view of the cylinder liner of FIG. 1.

In FIGS. 1 and 2, the typical cylinder liner preferred embodiment 15 is set forth. The flange 14 is shown at the top of the liner 15. The size of the cylinder varies for different engines and it has been difficult in the prior art because of the difference in melting temperatures of iron and aluminum to produce any cylinder liner casting with a bonded-on iron surface member 16, as displayed on the outer circumference of the three symmetrically placed aluminum ribs 17 for establishing thermal surface contact interface within a receiving aluminum engine block. In such use, strict dimensional tolerances of cylindrical roundness are imposed which have been exceedingly difficult to achieve in cast products, particularly for larger diameter pistons such as used for Diesel engines, for example. The manner of meeting such tolerances by rotating molds about the cylindrical axis of the liner is later discussed with respect to the precision casting process for manufacture of the cylinder liner afforded by this invention.

The interface bonding of the iron surface member 16 onto the integrally extending and thus strongly affixed cast aluminum ribs 17 is critical because of the significantly different melting temperatures of iron and aluminum. Note that the circumferential alignment of the aluminum ribs 17 presents the bonded iron surface members 16 perpendicular to the movement of the piston in the interior surface 18 of the aluminum liner body 15 to thus encounter high stresses at the interface surface between the liner body 15 and the aluminum engine block into which it is mounted. Thus, the bonding strength between the iron and aluminum components 16, 17, provided in the casting process of this invention is a significant improvement in the art.

Consider in more detail the eccentricity problems encountered in producing an acceptable product when the ribs 17 extend only about five millimeters from the generally cylindrical outer perimeter 19 of the liner body. The thinner iron surface contact layers 16 of about one millimeter thickness then present significant problems of obtaining precision roundness in manufacture. For this reason expensive machining processes and complex casting procedures would be required using conventional prior art techniques that would unduly increase the production costs of the bimetallic iron-aluminum piston liners to which this invention is directed.

Figure 3:
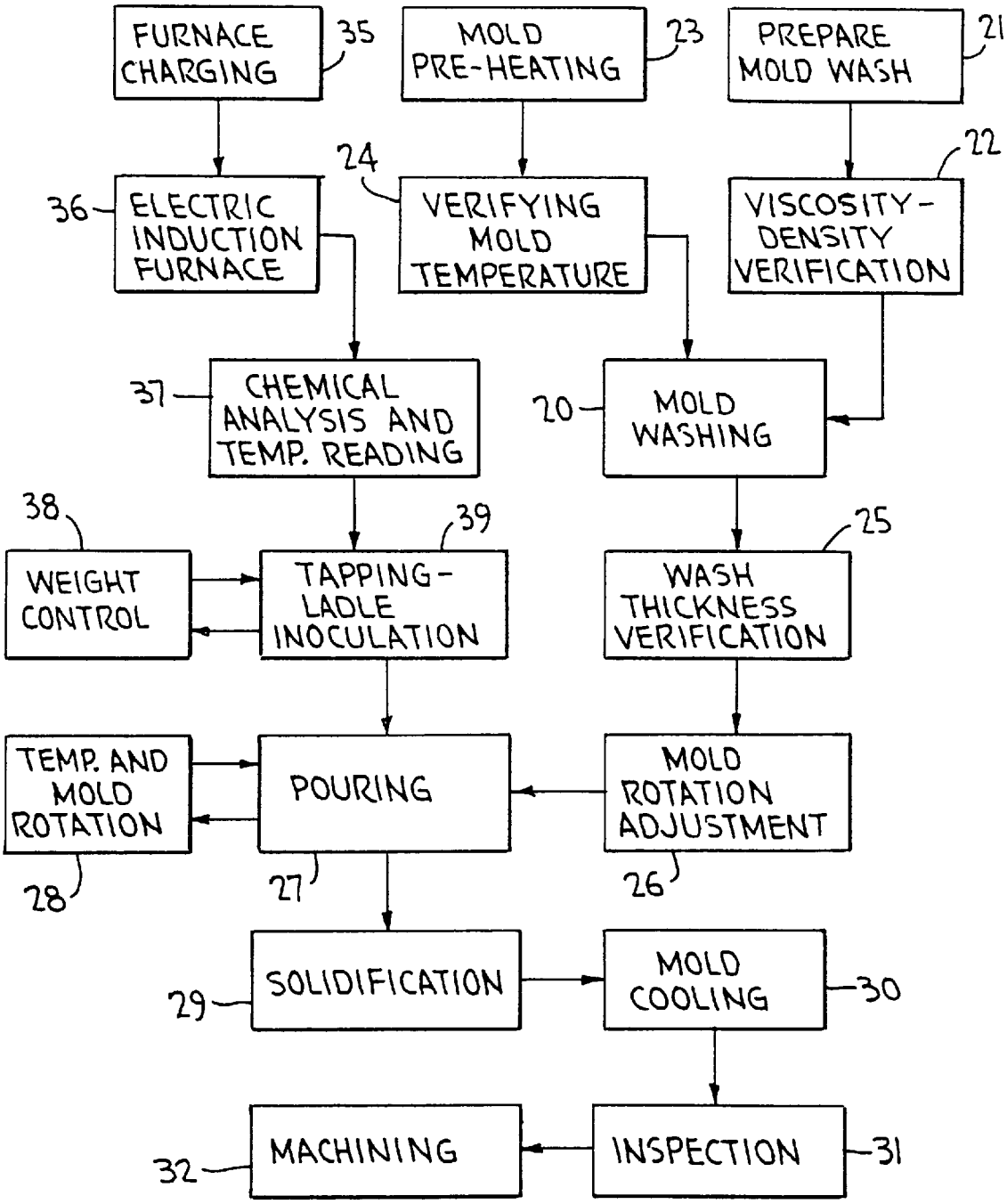
FIG. 3 is a flow diagram setting forth the method of making the cast cylinder liner afforded by this invention.

FIG. 3 is a flow diagram outlining the process of manufacturing the cast cylinder liners 15. The mold washing step 20 is critical in the formation of the roughened porous surface characteristic of the iron surface 16. The preferred wash constituency is obtained using a mixture of 25 pounds of silica flour, 200 mesh, with 0.875 pounds of western bentonite in 12 pounds of water with 3 ounces of concentrated detergent, typically Orvus brand marketed by Proctor & Gamble, is prepared at block 21 and verified at block 22. In an intial molding step for processing the iron liner member 16, this mixture, after being diluted by water to a viscosity range from 20 to 25 seconds, is then at block 20 washed upon the surface of the mold, which is then preheated to a processing temperature in the range of 140 to 160 degrees Centigrade in blocks 23, 24. This wash being appropriately applied to a thickness of one millimeter on the mold surface at block 25 serves to generate a set of substantially uniformly distributed bubbles in a solid matrix pattern into which molten iron may be poured to produce its roughened, porous surface characteristic.

The mold wash is applied to the internal mold surface by the use of a pressure tank and a spray nozzle. The appropriate bubble characteristics are controlled by the choice of air pressure, spray nozzle and the movement speed relative to the mold taking into account the mold rotation speed at block 26. The air bubbles formed in the dried wash surface provide a generally uniformly distributed pattern of pores. By pouring molten iron into the bubble formed pattern in the wash layer surface at pouring station 27, these pores are filled with iron to accordingly roughen the outer contact surface of the iron.

During the solidification phase, the mold is rotated about the axis of the liner cylinder at a desired temperature range as accomplished in block 28. After solidification (29) the mold cools to room temperature at block 30. After inspection 31, the cooled casting is machined at 32 to establish the specified length, internal diameter and outside body diameter. Because of the rotation of the molds, the precision tolerances required without eccentricity at the thin iron layer outer contact surface are achieved.

For charging the furnace with either molten iron or molten aluminum, starting at block 35, the melting is achieved by an electric induction furnace 36 or equivalent electric resistance furnace to provide a charge which has a verified chemical constituency and temperature (Block 37). Weight is controlled at block 38 for the tapping and ladle inoculation step at 39.

The pouring process for the aluminum cylinder liner block may be done in either a stationary sand or metallic mold, which is rotated at 28 during the solidification stage, piece shakeout and mold preparation at a controlled rotation rate.

In the general method of this invention for molding a cylindrical cast aluminum piston liner block having externally protruding aluminum ribs with a cast surface layer of iron the process steps are as follows:

fabricating, preparing and washing metal or sand molds, preheating metal molds for the molding step, placement of sand cores into the mold, preheating iron liners made in the foregoing way for processing said surface layer of iron in a mold, pouring the molten aluminum, soldifying and shaking out the cast aluminum block.

For processing the iron rings the method steps comprise:

producing a roughened outer surface on the cast iron layer by introducing a mold wash substance that produces a mass of bubbles in surface contact with molten iron poured into the mold, placement of the iron liner into a piston mold for producing the aluminum piston liner and pouring aluminum after preheating the piton mold and iron liner, and rotating said loads about the cylindrical axis of said piston liner during solidification of molten metal.

During the processing of the aluminum piston liner block, the pores on the outer surface of the iron rings may be filled with molten aluminum to strengthen the bond between the iron and aluminum.

Having therefore introduced improvements to the state of the art, those features of novelty relating to the spirit and nature of this invention are defined with particularity in the following claims.

What is claimed is:

1. A cast aluminum piston liner for insertion in an internal combustion engine between a piston and an engine block, comprising in combination:

a generally cylindrical cast aluminum liner body for receiving a piston having a plurality of spaced circumferential aluminum ribs extending therefrom for supporting a circumferential thermal contact surface member between the liner body and a mating surrounding engine block surface, wherein said thermal contact surface member is formed as a cast iron engine block contact member with a roughened outer cast surface, and the cast iron member is thermally bonded onto the circumferential aluminum ribs.

2. The piston liner of claim 1 wherein said roughened outer surface further exhibits surface indentations extending a depth of substantially one millimeter into the iron member.

3. The piston liner of claim 2 wherein said roughened outer surface is machined to form a mating surface with said surrounding engine block surface.

4. The piston liner of claim 2 wherein said roughened outer surface presents a relatively insulating thermal transfer characteristic between the piston liner and the surrounding engine block.

5. The piston liner of claim 1 with said liner having a defined length and having said spaced aluminum ribs arranged symmetrically along the liner length.

6. The piston liner of claim 1 wherein said ribs extend a distance in the order of 4 to 5 millimeters outwardly from said liner body.

7. The method of casting the piston liner defined in claim 1 including the step of centrifugally rotating a cylindrical mold during solidification of the molded product to produce acceptable circumferential rib outer dimensional tolerances suitable for surface contact between the liner and engine block.

8. The method of claim 7 further comprising the step of internally finishing an interior surface of the mold for adhering thereto a mold wash layer of a thickness of substantially one millimeter, said wash layer having the property of introducing bubbles in a subsequent mold preheating step.

9. The method of claim 8 further comprising the step of adhering the wash layer to said interior finished surface of the mold comprising a mixture of 25 pounds of Silica flour of 200 mesh, 0.875 pounds of western bentonite, 12 pounds of water and 3 ounces of a detergent concentrate.

10. The method of claim 8 further comprising the steps of preheating the mold before applying the wash layer to a temperature range of 140 to 160 degrees Centigrade, spraying the wash layer on the interior finished surface of the mold with controlled pressure, from a spray nozzle advanced at a controlled speed about the mold interior surface with the mold being rotated at a predetermined mold speed to provide a wash layer of predetermined thickness for a liner body of predetermined diameter.

11. The method of claim 8 further comprising the steps of pouring molten iron into the rotating mold to form an iron surface liner layer for adherence to internally disposed aluminum ribs of said piston liner, thereby forming said roughened outer surface by reaction of molten iron with said wash layer.

12. The method of claim 11 further comprising the steps of preheating the mold containing the iron surface layer to a temperature between 200 and 300 degrees Centigrade before pouring molten aluminum at a temperature around 700 degrees Centigrade into the rotating mold thereby to bond with the iron and aluminum surface layers and form said cylinder liner with the spaced circumferential ribs.

13. The method of claim 11 further comprising the step of filling the porous outer surface of the iron surface layer with molten aluminum.

14. The method of claim 11 further comprising the steps of cooling the mold to room temperature and removing the cast cylinder liner with the bonded iron surface layer.

15. The method of claim 13 further comprising the step of machining the outer surface of the ribs to a predetermined outer diameter dimension.

16. The method of claim 7 wherein the mold is a disposable sand mold.

17. The method of claim 7 wherein the mold comprises a tool steel mold and accompanying internal sand cores.

18. The method of claim 7 further comprising the steps of pouring molten aluminum and molten iron into a stationary mold.

19. A method of molding a cylindrical cast aluminum piston liner having externally protruding aluminum ribs with corresponding cast surface layers of iron, comprising the steps of:

preparing and preheating molds for each molding step, casting an iron liner to produce said surface layer of iron in a mold, producing a roughened outer surface on the cast iron layer by introducing a mold wash substance that produced a mass of bubbles in surface contact with molten iron poured into the mold, placement of the iron liner into a piston mold for producing the aluminum piston liner and pouring aluminum onto the iron liner after preheating the iron liner and mold, and rotating said loads about the cylindrical axis of said piston liner during solidification of molten metal.

20. A generally hollow cylindrical piston liner for insertion in an internal combustion engine between a piston and an engine block, comprising in combination: a cast aluminum piston liner body with a cast iron engine block contact surface member extending therefrom securely thermally bonded thereto and exhibiting a roughened contact surface.

21. The piston liner of claim 20 wherein said roughened contact surface comprises a substantially uniform pattern of pores into which is deposited molten aluminum.

22. A method of forming a generally hollow cylidrical piston liner body for insertion in an internal combustion engine between a piston and an engine block at an interface surface by the steps of casting an iron surface liner into a mold processed to produce a roughened interface surface, and casting molten aluminum onto the iron surface liner thereby to form said interface surface in a mold for processing a generally aluminum liner body.

* * * * *

UNITED STATES PATENT AND TRADEMARK OFFICE

CERTIFICATE OF CORRECTION

PATENT NO. : 6,138,630
DATED : October 31, 2000
INVENTOR(S) : Arturo Lazcano-Navarro It is certified that error appears in the above-identified patent and that said Letters Patent is hereby corrected as shown below:

Claim 15, column 6,
Line 7, "claim 13" should read -- claim 14 --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*